United States Patent [19]

Pedrosa Junior et al.

[11] 4,412,811

[45] Nov. 1, 1983

[54] HIGH CAPACITY OIL BURNER

[75] Inventors: Oswaldo A. Pedrosa Junior; Nilton Castro Couto; Raul C. Carvalho Fangueiro, all of Rio de Janeiro, Brazil

[73] Assignee: Petroleo Brasileiro S.A. - Petrobras, Rio de Janeiro, Brazil

[21] Appl. No.: 296,904

[22] Filed: Aug. 27, 1981

[30] Foreign Application Priority Data

Aug. 28, 1980 [BR] Brazil ..... PI8005447

[51] Int. Cl.[3] ..... F23D 11/02; F23J 7/00

[52] U.S. Cl. ..... 431/202; 431/4; 431/190; 431/343

[58] Field of Search ..... 431/4, 5, 190, 284, 431/285, 202, 343

[56] References Cited

U.S. PATENT DOCUMENTS

| | | | |
|---|---|---|---|
| 3,797,992 | 3/1974 | Straitz | 431/285 |
| 3,807,932 | 4/1974 | Dewald | 431/2 |
| 3,861,857 | 1/1975 | Straitz | 431/202 |
| 3,894,831 | 7/1975 | Glotin et al. | 431/4 |
| 3,980,416 | 9/1976 | Goncalves et al. | 431/202 |
| 3,995,985 | 12/1976 | Straitz | 431/284 |

*Primary Examiner*—Samuel Scott
*Assistant Examiner*—Lee E. Barrett

[57] ABSTRACT

The present invention relates to a high capacity oil burner comprising a cylindrical atomizer completely surrounded by a protective cylindrical housing having a diameter from 2 to 3 times greater than the diameter of said atomizer; liquid fuels being injected under pressure into said atomizer and accumulating within said atomizer in a chamber for the accumulation of liquid fuels, and compressed air being injected into a chamber for the accumulation of air; cylindrical holes communicating said chamber for the accumulation of liquid fuels with the outside and cylindrical holes communicating said chamber for the accumulation of air with said cylindrical holes communicating the chamber for the accumulation of liquids with the outside so that the injection of compressed air into said liquid fuel discharge holes atomizes said fuel which is expelled to the outside through the end portions of said discharge holes which are circumferentially positioned to be burnt by a pilot flame; said protecting cylindrical housing having at its ends perforated circular rings into which water is injected under pressure to form a protecting fan-like water curtain at the rear end of the housing and a fan-like water curtain at the flame to reduce the formation of soot; the burning efficiency of said burner being superior to 30 barrels of liquid fuel per day/kg of the apparatus.

2 Claims, 5 Drawing Figures

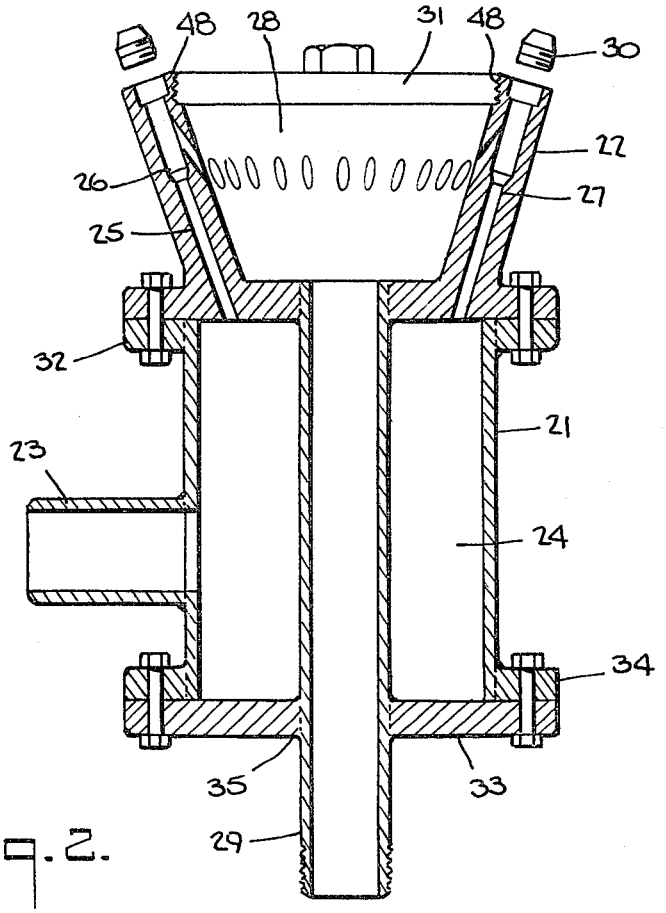
Fig. 2.
Fig. 3.
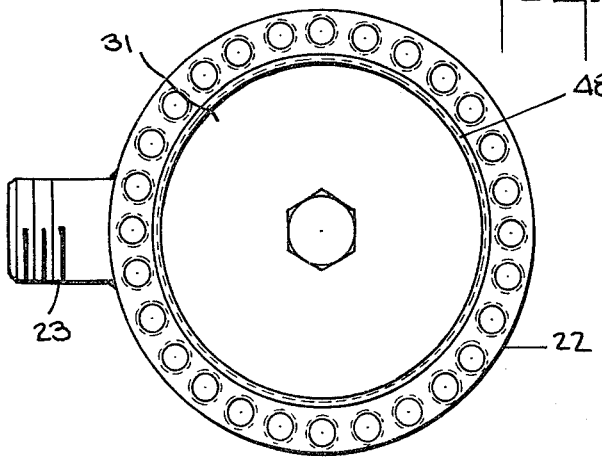

HIGH CAPACITY OIL BURNER

The present invention relates to a high capacity oil burner suitable for burning liquid fuels which are unwanted in several operations in which said liquid fuels could cause pollution or endanger the safety of installations as well as people.

The main feature of the present invention is to provide a small sized apparatus which burns large amounts of fuel with greater efficiency when compared to other burners of larger dimensions or to multiple assemblies of burning elements.

It is known that it is necessary to eliminate the first oil portions produced in an initial production test in an off-shore well, in order to avoid their being thrown out into the sea where they would cause pollution. This elimination is considered as efficient if these oil portions are burnt. Therefore, it is a relatively recent practice to provide off-shore drilling platforms with burners for burning unwanted liquid fuels as well as with the usual flows for the gases.

It is obvious (and this problem will be discussed in greater detail hereinafter) that the bigger the flow of oil to be eliminated, the bigger must be the burner dimensions or the number of small sized burners. The use of additional burners would, in its turn, lead to an excessive overweight on the superstructure of the platforms and, therefore, it is necessary to improve the burner efficiency, that is, its capacity for burning increasing quantities of liquid fuels without the necessity of enlarging its dimensions and, consequently, its weight. Therefore, the burner according to the present invention has a design that allows it, due to certain new and inventive features introduced in it, to provide a considerable weight reduction while still burning a great amount of liquid fuels without producing any soot.

Basically speaking, a burner according to the present invention comprises an atomizer to which are fed streams of liquid fuels to be burnt and pressurized air which acts as primary air and as a dispersant of the liquid fuel at the time of burning. Said atomizer is mounted within a housing having a diameter approximately two or three times the diameter of the atomizer so that the atomizer is completely surrounded by said housing. Said atomizer is formed by a first compartment into which fuel is admitted and a second compartment, adjacent to said fuel compartment, where compressed air is accumulated. Said air compartment is formed by a conical chamber having side walls provided with ports which communicate with other ports provided in said walls. These other parts are for the liquid fuel to flow from the interior of said fuel chamber to the outside, so that when the fuel is reached by the stream of compressed air coming from said air compartment it is atomized while at the same time the intersection of the two streams (air and fuel) creates an air horn effect which accelerates the flow of said fuel to a high rate.

The specific positioning of the atomizer within said external housing is responsible for the turbulence of the secondary air which enhances the burning efficiency. As it is disclosed in U.S. Pat. No. 3,980,416, assigned to the same assignee as the present application and corresponding to the Brazilian Patent Application PI 7402404, two water spraying rings are also provided. One of said rings, placed in the front end of the external housing of the burner, blows into the flame (through nozzles or ports in its circumference), at a certain angle, water in the form of small droplets, to reduce the formation of soot. The other ring is placed at the rear end of said housing and when water is pumped into it under a certain pressure the water is expelled outwardly (through nozzles or ports on its outfacing circumference) in order to form a fan-like spray in a plane normal to the axis of the burner, which fan-like spray protects the rear end of the burner against the radiation of the heat generated by the combustion of the fuel.

For a better understanding of the present invention by those skilled in the art it will now be described with reference to the attached drawings, in which:

FIG. 2 is a longitudinal cross-section of the atomizer where the liquid fuels are ignited;

FIG. 3 is a front view of said atomizer;

Figure 1:
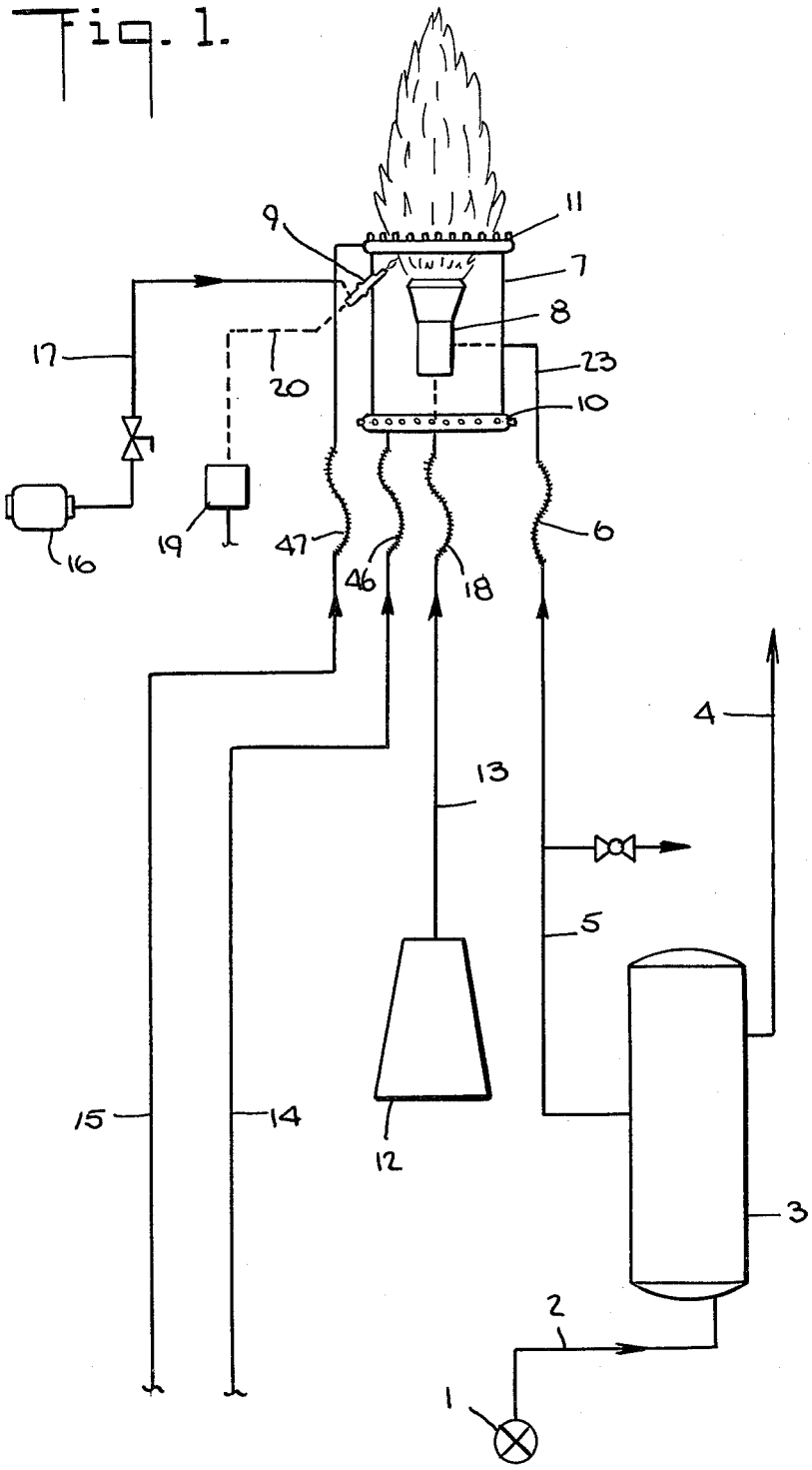
FIG. 1 is a schematic view of a burner structure in an oil production well.

With reference now to FIG. 1, the oil produced during the initial tests of a well 1 is directed through line 2 to a separator vessel 3 from which the gas is directed to the flare through line 4. The oil that comes out through line 5 is passed through a flexible hose 6 which connects with manifold 23 which, in its turn, leads to the interior of the atomizer 8. Within said atomizer 8 the oil is atomized by an injection of compressed air supplied by a compressor 12 which is connected to said atomizer by means of a manifold 13 and a flexible hose 18. The combustion process is initiated when the flow of atomized oil comes into contact with a pilot flame provided by an igniter 9 in which the sparking promoted by an elevated electrical voltage (around 10,000 Volts) supplied by a transformer 19 burns the gas coming from a source 16 of liquified petroleum gas or acetylene directed to said burner through a special line 17. The ignition system is supplied with electricity by a special line 20 which is able to resist corrosive environments and high temperatures.

The burner assembly 7 is provided with a cylindrical housing 42 to stabilize the flame, open at both ends, which surrounds the atomizer 8 and the igniter 9. Said cylindrical housing 42 has a circumferentially perforated ring 10, 11 at each of its free ends which are provided with water spraying nozzles associated with each port. Pressurized water is pumped into said rings and is sprayed forming a fan-like curtain outside the burner. The nozzles 37 on the ring 10 placed at the rear end of said housing 42 are positioned in such a way that the water curtain is formed in a plane normal to the longitudinal axis of said atomizer 8. The ring 11 placed at the front end of said housing 42 has its water spraying nozzles 38 inwardly directed towards the longitudinal axis of said atomizer, at an angle from 3° to 5° with a hnorizontal plane, so that the water curtain defines a slightly conical housing from said nozzles, surrounding said flame, in such a manner as to reduce the formation of soot during burning.

Water is delivered to said ring 10 by means of a manifold 14 having a joint, which is connected to said ring at two different inlets. A manifold 15 delivers water to said ring 11, which manifold has a joint and is connected to said ring at two different inlets.

When the flame within the burner is turned on, the water curtain from the rear ring 10 acts as a shield against the radiation of heat from the flame to the installations.

FIG. 2 shows a side view of said atomizer 8 while FIG. 3 shows a front view of the atomizer.

To make the description and the understanding easier, said atomizer 8 can be divided into two main parts: (a) a cylindrical body 21 to accumulate the oil to be burnt, defining a chamber 24; and (b) a burning head 22 where said oil is atomized and burnt.

The oil to be burnt, coming from said separator 3, penetrates the atomizer body 21 through an admission manifold 23, filling the chamber 24. Said accumulation chamber 24 is in the shape of a cylindrical ring surrounding the manifold 29 for admission of primary air for the burning. The rear end of said chamber is sealingly closed by a cover 33 which is secured to a flange 34 on said cylinder 21 by bolts.

It must be noticed that for safety reasons the manifold 13 for the admission of air is connected to said manifold 29 of the atomizer by means of a check valve 36. The front end of said chamber 24 is closed by the rear end of the burning head 22 which is secured by bolts on a flange 32 on said cylinder 21. The manifold 23 for the admission of the oil to be burnt opens to the side wall of said cylinder 21.

The burning head 22 is defined by a hollow frusto-conical body whose smaller end forms the front wall which is secured to said flange 32 on the cylinder 21 of said oil accumulation chamber; the larger end of said frusto-conical body is facing the outside and defines the front end of said atomizer. Said larger base is formed by a disc 31 which closes the hollow frusto-conical body defining said air accumulation chamber 28. According to the preferred embodiment of the present invention, said disc 31 is secured to said burning head 22 by means of a thread 48.

The conical wall of the burning head 22 is thick enough to have a plurality of elongated holes there through, which holes communicate the interior of said oil accumulation chamber 24 with the location where said oil is burnt.

Said holes (or ports) start from the burning head wall 22 facing the interior of said chamber 24 having the shape of cylindrical elongated channels 25 whose diameters, at a point intermediate of said conical wall, are enlarged into holes 26, having a diameter larger than that of said channels 25, which connect said point with the outside of said wall. Outside said wall discharge nozzles 30 having a smaller diameter than said holes 26 are secured to said wall, and the oil is burnt in said nozzles.

The inner surface of said conical wall of the burning head 22 facing the interior of said air accumulation chamber 28 is provided with holes 27 (slightly inclined with reference to the longitudinal axis of said hole 26) which communicate the interior of said chamber 28 with said elongated holes 26. It is to be noted that the number of said holes 25–26 may be variable and that the number of elongated channels 25 is equal to the number of holes 26 so that there is only one channel for conducting air from said chamber 28 to each of said holes 26 and, accordingly, to the exterior of said atomizer. Only as a non-limiting example, the number of holes 25–26 in the drawings is 28.

The inclination of said holes 25–26 with respect to the central axis of the atomizer is from 10° to 35°, so that when the flame is turned on it suffers a slight conical expansion and does not pass through the water curtain from the nozzles 38 of the front ring 11. Generally speaking, it is necessary that the atomizer 8 be concentric with said cylindrical housing so that there may be a satisfactory cyclone effect on the secondary air within the space defined by said cylindrical housing.

To provide a variable positioning for the flame in order to avoid unwanted air streams which might adversely affect the combustion, the burner assembly is supported on a rotating train that allows the assembly to be rotated up to 120°.

Figure 4:
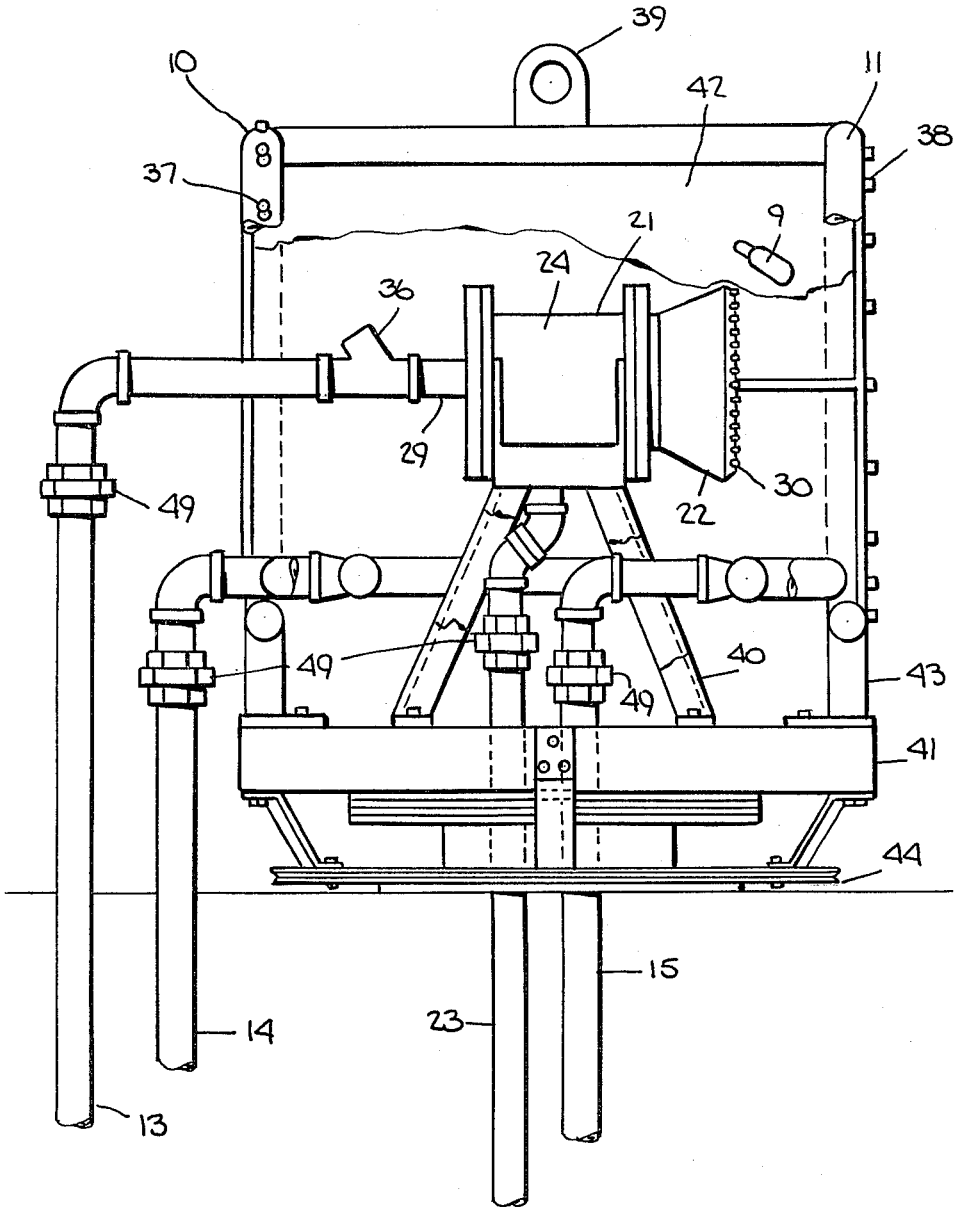
FIG. 4 is a lateral cross-section of said burner assembly.
Figure 5:
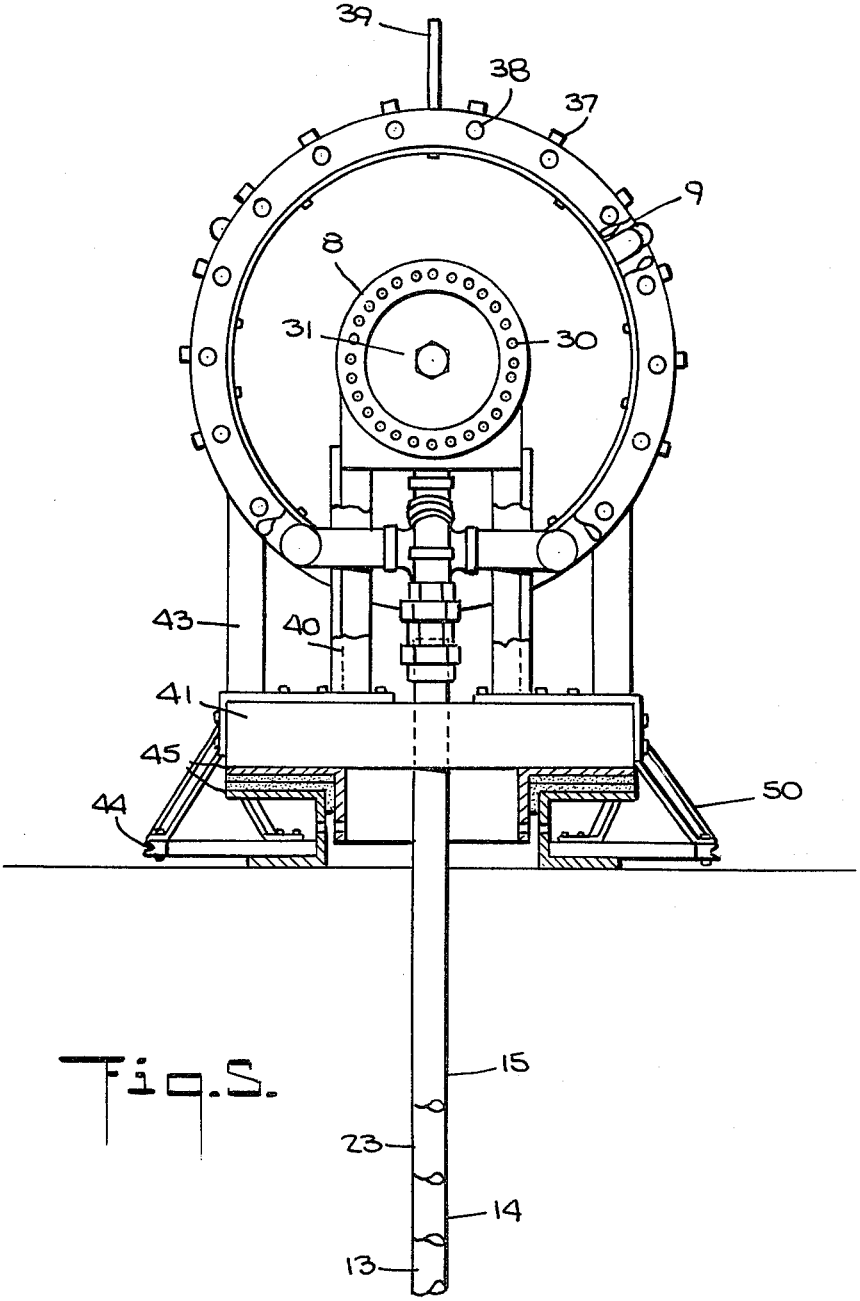
FIG. 5 is a front view of the burners assembly shown in FIG. 4.

From FIGS. 4 and 5 the following important details can be noticed:

(a) the body of said atomizer 8 is supported on the pedestal 41 of the assembly by means of legs 40;

(b) the housing 42, together with the water spraying rings 10 and 11 is supported by means of legs 43;

(c) the manifolds 13, 14, 15 and 23 that deliver compressed air, water and oil to the burner, as the assembly can be rotated, are connected to the external manifolds through said flexible hoses 6, 18, 46 and 47 above mentioned;

(d) the rotating system itself comprises essentially a wheel 44 upon which said pedestal 41 is supported by means of connecting intermediary rings 45 made of laminated and re-inforced plastic, the system being supported by means of legs 50;

(e) said wheel 44 is linked to an electric motor (not shown in the drawings) that drives the assembly for rotation through an angle of up to 120° around a vertical axis;

(f) the manifolds for the admission of air, water and fuel to said atomizer 8 are provided with removable joints 49, so that it is easy to remove said burner and to lift it by means of an eyelet 39 where the hook of a crane can be easily inserted.

After the description of the parts which constitute the burner, its operation will now be described.

Oil is admitted to the chamber 24 of the atomizer 8 through the manifold 23, with oil passing through the channels 25 and being submitted to an expansion within the elongated holes 26 until it comes out of the reduced diameter holes in the nozzles 30.

The compressed air coming from the compressor 12 passes through the manifold 13 with the check valve 36 to the manifold 29. Said manifold 29 passes through the rear plate 33 of the oil accumulation chamber 24, the manifold being secured to said plate by a welding junction 35 which ensures a water tight condition to said rear wall of the chamber. Said manifold 29 extends across all the chamber 24 and opens to the burning head 22 (where air is accumulated within said hollow chamber 28 to be expelled under pressure through the holes 27) in order to provide the atomization of the oil that is being expelled through the holes 26, so that a mixture of oil and primary air comes out through the nozzles 30 where it is ignited when it contacts the flame provided by said ignitor 9. The secondary air necessary to balance the combustion is admitted under turbulence through the cylinder, open at both ends, defined by said housing 42, the air being drawn as a natural consequence of the turbulence of the hot gases created by the "torch" formed by the flame of said assembly of burning nozzles 30. At the same time, while the "atomized" oil is burning as it is being expelled through the nozzles 30, water under pressure is pumped into the rings 10 and 11 of the housing 42 forming a rear shielding curtain (from the rear ring 10) and a water spraying curtain on the flame (from the front ring 11).

The introduction of an air stream in a fuel oil stream flowing through a plurality of tubular holes 25, 26 (in such a way that the air reaches the oil through tubular holes 27 that form an angle from 10° to 30° with the oil discharging holes 25, 26, the air coming under pressure from the accumulation chamber 28 defined by said thick conical wall 22 where said oil and air discharging holes 25, 26 are positioned), together with the positioning of the atomizer within said protecting housing of the burner provide a high burning efficiency for a low weight of the equipment. That is particularly convenient because an apparatus having a low weight can be transported more easily to places difficult of access and can be easily installed, the burner being relatively easily adapted to different working conditions.

It is known that crude oil has a very high combustion heat, and that is the reason why the burners produce an excessive heating of the environment near the wall. For this reason the oil to be burnt must be as far as possible from the wall. In off-shore drilling platforms, this is done by means of a cantilevered elongated structure projecting from the platform towards the sea, the burner being positioned at the distal end of said structure (called a "boom").

In this way the burner flame is kept away from the main equipment on the platform. However, if the length of the boom must be excessive, it will cause problems to the stability of the structure, firstly because it has heavy equipment at the end of a cantilevered "boom"; secondly because the burning of a product at high capacity always creates a small vibration of the burner which will, in its turn, cause some vibration at the boom, with hazardous consequences for all the structures as seems obvious to those skilled in the art.

It was necessary to find a way to reduce the need for long booms. The most efficient way was the use of water curtains, the solution that was used in the above mentioned U.S. Pat. No. 3,980,416 and Brazilian Patent Application No. PI 7402404.

The burner is provided with a manifold in the shape of a circular closed ring having holes or nozzles which communicate with the outside; said manifold surrounding the cylindrical housing of the burner in a variable position with respect to the torch, as shown in the drawings. Water is pumped into said circular manifold and it is expelled from the manifold forming a water curtain that acts as thermal insulation which protects the parts of the platform structure positioned behind the burner from excessive heat radiation.

Another problem that was found in prior art burners was the quality of the burning. In said prior art burners rates of up to 10,000 barrels per day could not be achieved without forming great amounts of a black smoke which, depending on the direction of the wind, would become harmful to the operation of the platform.

As a matter of fact, a smooth and sootless burning could only be achieved at approximately 83% of said maximum rated output in the most favourable conditions, and at approximately 20% of said output at most conditions.

French Patent No. 2.154.901 and the above mentioned U.S. Pat. No. 3,980,416 and Brazilian Patent application No. PI 7402404 taught how to alleviate this problem by injecting water onto the flame. However, it was necessary to reduce as much as possible the weight of the burner to obtain a certain burning efficiency without forming any soot.

In order to evaluate the "actual" efficiency of the burner when burning liquid fuel products while saving material and not overloading unnecessarily the off-shore drilling platform, an empirical number was used which represents the number of barrels per day for each kg of the apparatus weight. This number is the result of the division of the maximum burning capacity each day in barrels per day by the weight expressed in kg of the burner. Comparative data between the index number of the high capacity burner of the present invention and the index numbers of the commercially available burners of the prior art show that the burner according to the present invention is superior to the others.

The high capacity burner of the present invention presents a burning efficiency rate of 34.2 barrels per day/kg without producing any soot, while the burner manufactured by Flopetrol which was being used until 1975 had an index number of 16 barrels per day/kg; the new burner from Flopetrol used since 1975 has an index number of 24 barrels per day/kg, that without producing any soot; the John Zink burner manufactured by Baker Oil Tools under the commercial name Baker-Zink burner has an index number of 20 barrels per day/kg when producing soot, and 3.3 barrels per day/kg without producing any soot (according to the data of the Composite catalogue published by Gulf Publishing Company, 1973); the Otis burner has an index number of 10 barrels per day/kg.

The above data make it possible to see the superior efficiency of the burner according to the present invention, which reduces the weight of the equipment necessary to burn a high capacity of liquid fuels, which represents a great improvement when compared to the prior art.

We claim:

1. High capacity oil burner suitable for burning unwanted liquid fuels, comprising:

(a) an atomizer (8) including a chamber (24) for accumulating liquid fuels adjacent to a chamber (28) for accumulating compressed air which supplies primary air for the atomization of the liquid fuels at the time of burning, said chamber (24) for accumulating liquid fuels being provided with a plurality of discharge holes (25,26) on its front end, circumferentially positioned, which open to outside the chamber;

(b) a protective cylindrical housing (42) open at both ends which surrounds completely said atomizer, said housing having at each end a hollow circular ring (10, 11) provided in its external surface with respective holes (37,38), each of said circular rings being connected to a water manifold (14, 15) which injects water under pressure into said rings (10,11) such that the water is expelled to the outside through said holes defining a fan-like water curtain around said cylindrical housing (42);

(c) means for the admission of liquid fuels into said chamber for the accumulation of liquid fuels, means for the admission of compressed air into said chamber for the accumulation of compressed air and means for the admission of water into said perforated rings which surround the ends of said protective cylindrical housing; and (d) means (9) to promote the ignition of said atomized liquid fuels that are expelled to the exterior of said chamber for the accumulation of liquids together with primary air;

characterised in that said chamber (28) for the accumulation of compressed air is defined by a frusto-conical hollow body having a conical side wall (22) which is at an angle from 10° to 35° with the longitudinal axis of the atomizer, and which is thick enough so that inside it are positioned holes (25,26) having the shape of straight cylindrical channels which communicate the interior of said chamber for the accumulation of liquid fuels with the outside; the front face of said body being the smaller base of the frusto-conical body and being adjacent to the chamber (24) for the accumulation of liquid fuels and having a central hole where the conduction manifold (29) that receives the compressed air from outside the burner into said chamber (28) opens; said front face having a plate (31) that seals completely the opening at the larger base of the frusto-conical body; the inner surface of said conical side wall (22) having a plurality of elongated holes (27) that start inside the chamber (28) for the accumulation of compressed air and open to said elongated holes (25,26) which communicate the chamber (24) for the accumulation of liquid fuels with the outside; said fuel discharge holes (25,26) opening at the front end of the atomizer having nozzles (30) that surround said sealing plate (31) at the larger base of the frusto-conical body through which the atomized liquid fuel to be burnt is expelled; the atomizer (8) being positioned within said protective cylindrical housing (42) in such a manner that the front end of said atomizer is spaced apart from said cylindrical housing and the rear end of said atomizer is also spaced apart from the rear end of said cylindrical housing; the inner diameter of said cylindrical housing (42) being from 2 to 3 times the diameter of the front end of said atomizer and the length of said housing being from 1 to 1.5 times the length of said atomizer; the burning efficiency of the burner when measured by the number of barrels of fuel burnt as related to the weight of said burner expressed in kg being above 30 barrels of fuel burnt per day/kg of the apparatus, without producing any soot.

2. High capacity oil burner as defined in claim 1, characterized in that the burner assembly is mounted on an off-shore drilling platform and is provided with rotating means so that the burner assembly can be rotated up to 120° around a vertical axis.

* * * * *